US009787037B2

(12) United States Patent
Buenz

(10) Patent No.: US 9,787,037 B2
(45) Date of Patent: Oct. 10, 2017

(54) POWER ADAPTER FOR RF COAXIAL CABLE AND METHOD FOR INSTALLATION

(75) Inventor: Lawrence J Buenz, Frankfort, IL (US)

(73) Assignee: CommScope Technologies LLC, Hickory, NC (US)

( * ) Notice: Subject to any disclaimer, the term of this patent is extended or adjusted under 35 U.S.C. 154(b) by 970 days.

(21) Appl. No.: 13/488,761

(22) Filed: Jun. 5, 2012

(65) Prior Publication Data

US 2013/0323965 A1 Dec. 5, 2013

(51) Int. Cl.

| | |
|---|---|
| ***H01R 9/05*** | (2006.01) |
| ***H01R 24/38*** | (2011.01) |
| ***H01R 24/54*** | (2011.01) |
| *H01R 31/08* | (2006.01) |
| *H01R 101/00* | (2006.01) |

(52) U.S. Cl.

CPC ..... *H01R 24/38* (2013.01); *H01R 24/542* (2013.01); *H01R 31/08* (2013.01); *H01R 2101/00* (2013.01); *Y10T 29/49117* (2015.01)

(58) Field of Classification Search

CPC .. H01R 24/38; H01R 24/542; H01R 2101/00; H01R 31/08; Y10T 29/49117

USPC ..... 439/578, 668–669, 581, 677, 736

See application file for complete search history.

(56) References Cited

U.S. PATENT DOCUMENTS

| | | | | |
|---|---|---|---|---|
| 4,954,084 | A | 9/1990 | Pugh et al. | |
| 5,364,281 | A | 11/1994 | Leto | |
| 5,376,022 | A * | 12/1994 | Carr et al. | 439/668 |
| 5,460,532 | A | 10/1995 | Leto | |
| 5,462,445 | A | 10/1995 | Anhalt | |
| 5,928,032 | A | 7/1999 | Dreesen | |
| 6,039,609 | A | 3/2000 | Hauver, Sr. et al. | |
| 7,306,484 | B1 | 12/2007 | Mahoney et al. | |
| 7,357,641 | B2 | 4/2008 | Kerekes et al. | |
| 7,708,592 | B2 | 5/2010 | Schnare | |
| 7,713,071 | B2 | 5/2010 | Pearce | |
| 8,106,297 | B1 | 1/2012 | Kiely | |
| 2002/0090860 | A1 | 7/2002 | Bohmer et al. | |
| 2004/0002266 | A1 | 1/2004 | Hinkle et al. | |
| 2004/0029433 | A1 | 2/2004 | Lee et al. | |
| 2007/0218755 | A1 | 9/2007 | Weiss | |
| 2007/0298653 | A1 | 12/2007 | Mahoney et al. | |

FOREIGN PATENT DOCUMENTS

| | | |
|---|---|---|
| EP | 1182744 A2 | 2/2002 |
| KR | 1020070027769 | 3/2007 |

OTHER PUBLICATIONS

Kim Sung Gon, International Search Report for Corresponding PCT application PCT/US13/40029, Sep. 27, 2013, Daejeon Metropolitan City, Korea.

(Continued)

*Primary Examiner* — Jean F Duverne

(74) *Attorney, Agent, or Firm* — Myers Bigel, P.A.

(57) ABSTRACT

An adapter for coupling a coaxial interface to a power conductor and method for interconnection may be provided as a body with a conductor junction dimensioned to couple with the power conductor and a mating surface dimensioned to couple with the coaxial interface. The conductor junction, an outer conductor contacting portion of the mating surface and an inner conductor contacting portion of the mating surface are electrically coupled together by the body.

20 Claims, 4 Drawing Sheets

(56) References Cited

OTHER PUBLICATIONS

Stephan Camerer, European Search Report for related application EP13801449, Oct. 20, 2015, European Patent Office, The Hague, The Netherlands.
Office Action corresponding to Chinese Application No. 201380028167.2 issued Nov. 17, 2016.

* cited by examiner

POWER ADAPTER FOR RF COAXIAL CABLE AND METHOD FOR INSTALLATION

BACKGROUND

Field of the Invention

This invention relates to electrical cable connectors. More particularly, the invention relates to an adapter for repurposing an RF coaxial cable as an electrical power transmission line.

Description of Related Art

Remote Radio Head (RRH) installations position the transceiver proximate the antenna, for example on top of a radio tower. RRH thus eliminates the prior requirement of transmitting the RF signals to/from the transceiver between the ground and antenna(s) located on the radio tower via RF coaxial cable. A conversion between conventional ground based transceivers and RRH systems creates the need for delivering the full transceiver electrical power to the top of the radio tower and renders the previously utilized RF coaxial cable(s) between the ground and top of the radio tower obsolete. Depending upon the desired transmission power, the power requirements of the RRH transceiver may be significant.

U.S. Pat. No. 7,708,592, issued 4 May 2010, discloses an adapter for adapting existing RF coaxial cables for use as electrical power conductors. The U.S. Pat. No. 7,708,592 adapter connects to existing connector interfaces at the ends of the RF coaxial cable to couple one conductor of a dual conductor power cable to the inner conductor of the coaxial cable and the other to the outer conductor of the coaxial cable, to provide positive and negative branches of an electrical circuit between an RRH transceiver and a power supply.

Therefore, it is an object of the invention to provide a power adapter for coaxial cable and method of use that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

Figure 1:
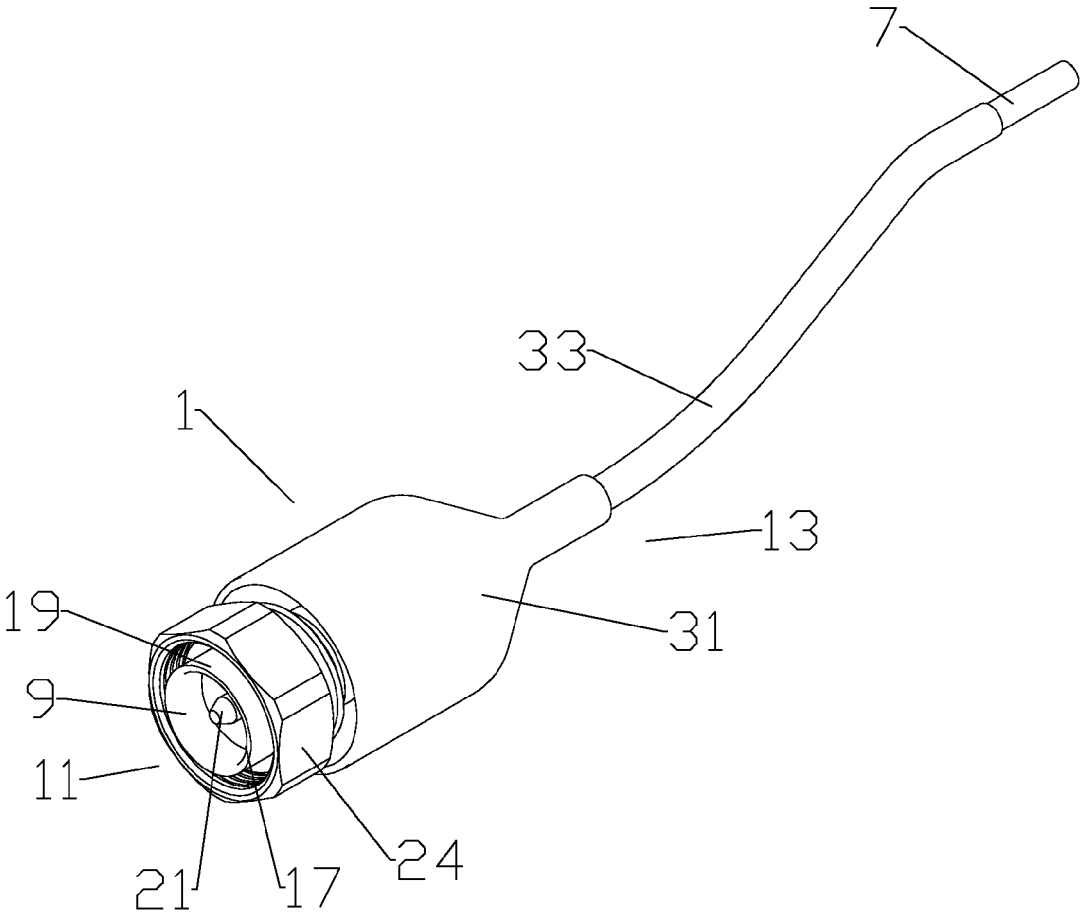
FIG. 1 is a schematic isometric view of an exemplary embodiment of a male 7/16 DIN adapter coupled to a power conductor, ready for interconnection with a female 7/16 DIN coaxial interface.
Figure 2:
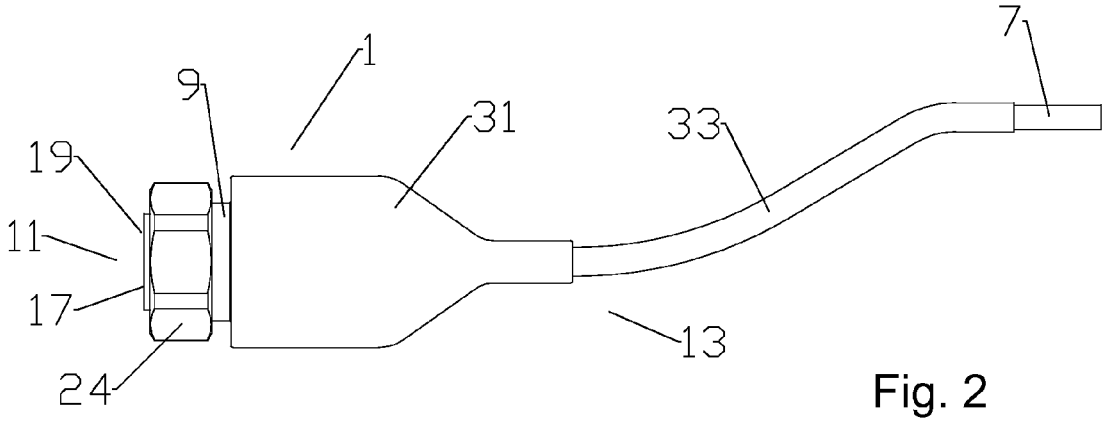
FIG. 2 is a schematic side view of the adapter and power conductor of FIG. 1.
Figure 3:
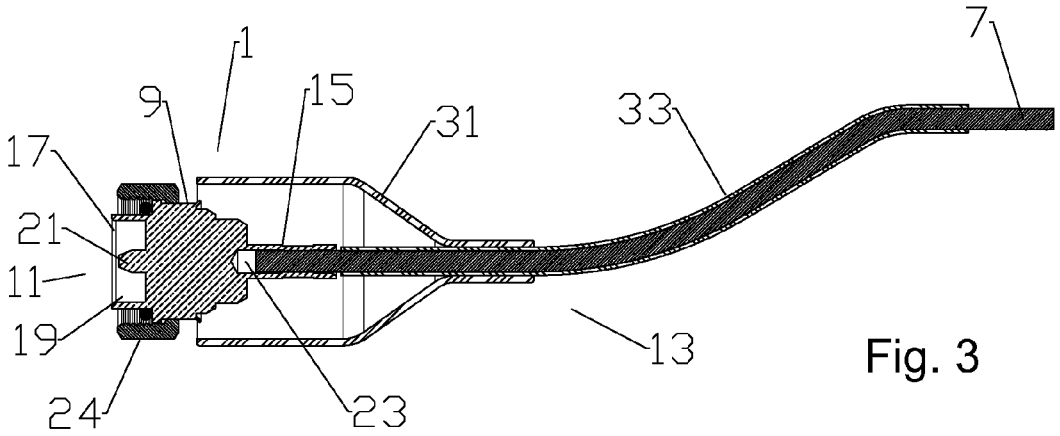
FIG. 3 is a cut-away side view of FIG. 2.
Figure 4:
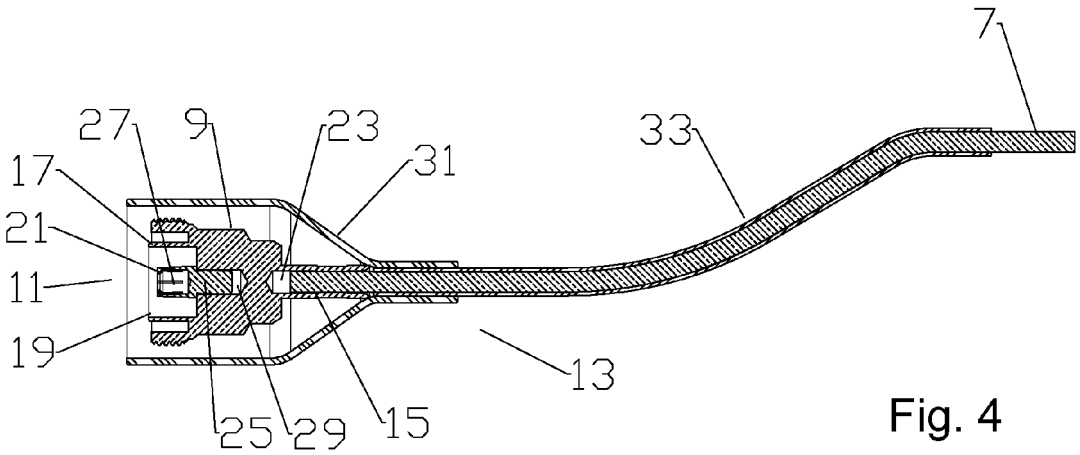
FIG. 4 is a schematic cut-away side view of an exemplary embodiment of a female 7/16 DIN adapter coupled to a power conductor, ready for interconnection with a male 7/16 DIN coaxial interface.

The inventor has recognized that power requirements of remote devices, such as RRH transceivers, may exceed the current carrying capacity of the inner and/or outer conductor of different configurations and/or sizes of existing RF coaxial cables available for repurposing to serve as electric power transmission lines. Some RF coaxial cables may utilize an inner conductor comprising a polymer rod or tube with only a thin metallic coating. Other RF coaxial cable configurations may utilize thin foil outer conductors. In such RF coaxial cables and/or conventional RF coaxial cables of small overall diameter, the electrical current carrying capacity of the inner and/or outer conductors may be insufficient to deliver the required level of electrical power to, for example, an RRH transceiver and/or other power consuming devices. Further, as existing RF coaxial cables are typically already provided with coaxial interface terminations at each end, the internal conductor configuration of an installed RF coaxial cable may not be readily apparent.

An exemplary embodiment of an adapter 1 for utilizing an RF coaxial cable as a high current capacity electrical power transmission line is demonstrated in FIGS. 1-5. The adapter 1 couples both the inner conductor and the outer conductor of an RF coaxial cable 3 terminated at a coaxial interface 5 to a single power conductor 7. Thereby, all of the conductive material of each RF coaxial cable 5 may be utilized as a combined single conductor for electrical power transmission. Two existing RF coaxial cables 5, each coupled to a power conductor 7 at each end by an adapter 1, may thus be repurposed to provide plus and minus (or hot and neutral) portions of a high current electrical power transmission circuit. Further, a single pair of RF coaxial cables 5 repurposed as high current capacity electrical power transmission lines may be utilized to provide electrical power to a plurality of RRH transceivers and/or other power consuming devices by adding a power distribution circuit to the electrical power consumers near the tower top end of the repurposed RF coaxial cables 5.

Figure 5:
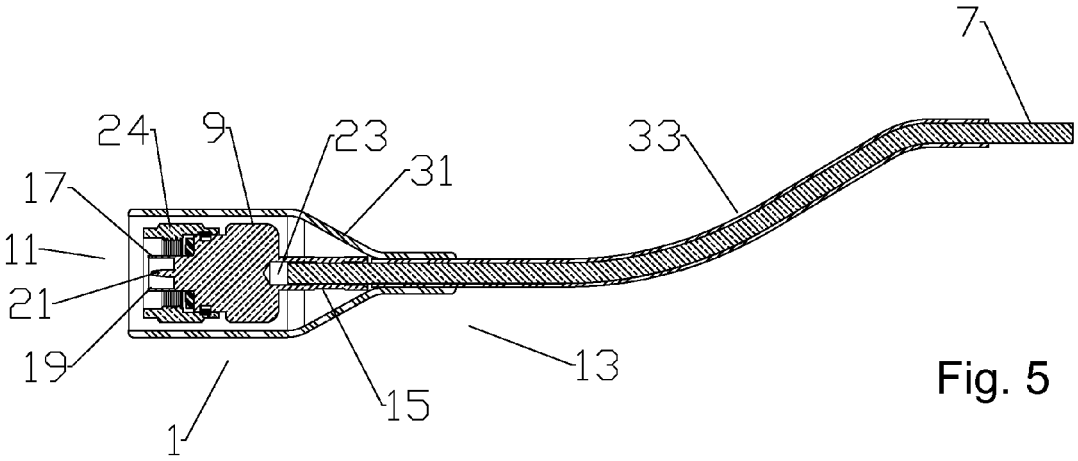
FIG. 5 is a schematic cut-away side view of an exemplary embodiment of a male Type N adapter coupled to a power conductor, ready for interconnection with a female Type N coaxial interface.

The adapter 1 may be provided as a body 9 with a connector end 11 and a conductor end 13. A conductor junction 15 at the conductor end 11 may be dimensioned to couple with the desired power conductor 7. A mating surface 17 at the connector end 11 is dimensioned to couple with the selected coaxial interface 3. Depending upon the type of coaxial interface 3 terminating the selected RF coaxial cable 5, the mating surface 17 is dimensioned to mate therewith, adopting the dimensions of a standardized or proprietary coaxial interface 3, for example, a male or female 7/16 DIN (as shown in FIGS. 1-4) or Type-N (as shown in FIG. 5) coaxial connector interface.

The conductor junction 15, an outer conductor contacting portion 19 of the mating surface 17 and an inner conductor contacting portion 21 of the mating surface 17 are coupled together electrically, formed for example from a body 9 that is a unitary monolithic portion of metal material.

The conductor junction 15 may be aligned coaxially with the outer conductor contacting portion 19, formed as a cylindrical projection from the conductor end 11 of the body 9, coaxially with a longitudinal axis of the body 9. An inner diameter of the cylindrical projection bore 23 may be dimensioned to receive the power conductor 7 therein, retained, for example, by crimping the conductor junction 15 around the power conductor 7 and/or soldering the power conductor 7 to the sidewalls of the cylindrical projection bore 23.

Where the mating surface 17 adopts a coaxial interface configuration that includes a coupling nut 24 (such as a male 7/16 DIN or Type N as shown in FIGS. 1-3 and 5) for retaining the coupling between the mating surface 17 and coaxial interface 3, a coupling nut 24 may be provided rotatably retained to an outer diameter of body 9 proximate the connection end 11.

Female coaxial interface configurations (such as female 7/16 DIN or Type N) may require the inner conductor mating portion 21 to have an inward biased spring characteristic. To provide such functionality without requiring complex machining and/or use of an expensive metal with resilience characteristics for the entire body 1, a contact pin 25 with a spring basket 27 of suitable material and spring characteristics may be provided seated in an inner conductor cavity 29 of the body 9, as shown for example in FIG. 4.

Because both the inner conductor and outer conductor paths are energized, the outer surfaces of the adapter 1 may present an electrical short and/or shock hazard when energized. To isolate the adapter 1 electrically, a dielectric boot 31 may be provided. The dielectric boot 31 may be dimensioned to seat along a power conductor jacket 33 of the power conductor 7, surrounding a longitudinal extent of an outer diameter of the body 1 and coupling nut 24, if present.

Figure 6:
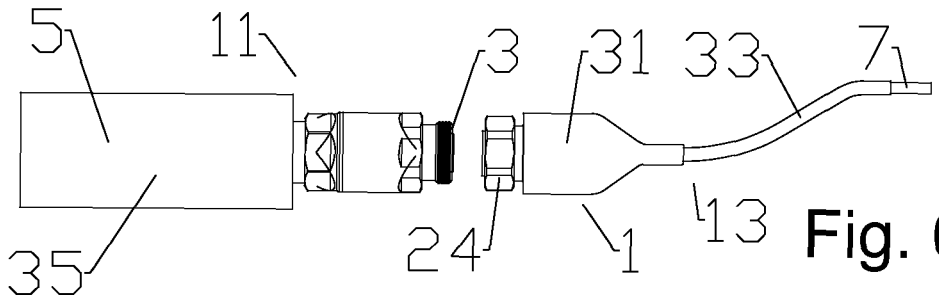
FIG. 6 is a schematic side view of the adapter of FIG. 1, aligned ready for interconnection with the coaxial interface of an RF coaxial cable.
Figure 7:
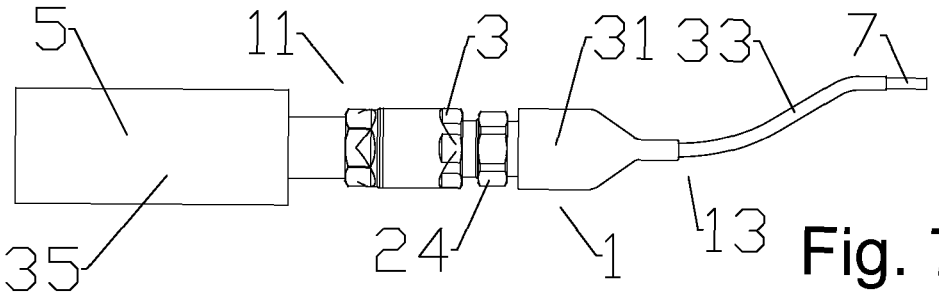
FIG. 7 is a schematic side view of the adapter of FIG. 6, interconnected with the coaxial interface of an RF coaxial cable.
Figure 8:
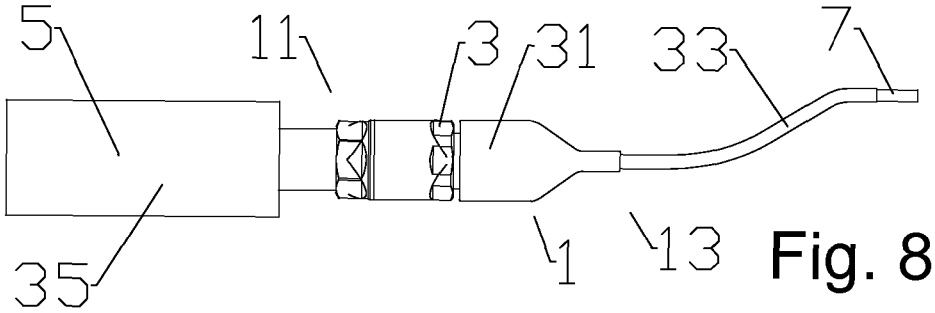
FIG. 8 is a schematic side view of the adapter of FIG. 7, with the dielectric boot advanced to cover the longitudinal extent of the adapter.

To couple a power conductor 7 to a coaxial interface 3, thereby repurposing an RF coaxial cable 5 with such coaxial interface 3 for use as an electrical power transmission line, the dielectric boot 31 may be applied to the power conductor 7, the conductor junction 15 coupled to the power conductor 7 (FIG. 6) and the mating surface 17 coupled to the coaxial interface 3 (FIG. 7) before the dielectric boot 31 is slid along the power conductor 7 toward the connector end to 11 cover the exposed portions of the adapter 1, surrounding a longitudinal extent of an outer diameter of the body 9 (FIG. 8).

Figure 9:
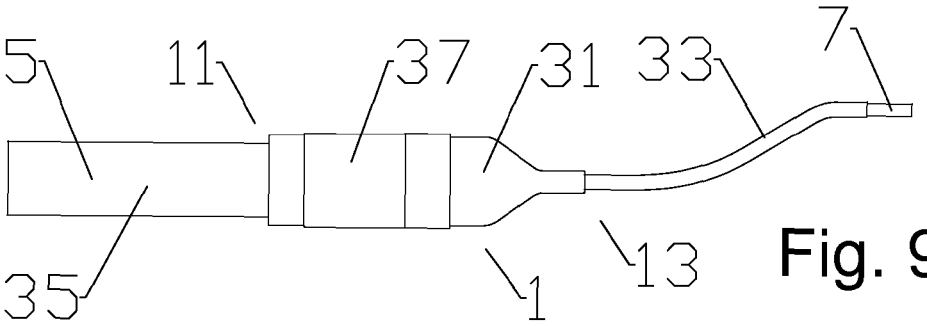
FIG. 9 is a schematic side view of the adapter of FIG. 1, interconnected with the coaxial interface of an RF coaxial cable, the coaxial interface sealed between the dielectric boot of the adapter and the jacket of the coaxial cable by a heat shrink sleeve.

The coaxial interface 3 of the RF coaxial cable 5 may have varying lengths of exposed metal (coaxial connector and/or outer conductor of the RF coaxial cable 5), presenting another electrical short and/or shock hazard when the power conductor 7 is energized. The exposed metal may be enclosed between the dielectric boot 31 and the coaxial cable jacket 35 of the RF coaxial cable 5, for example, by sealing this area with dielectric material such as a dielectric heat shrink sleeve 37 (FIG. 9).

One skilled in the art will appreciate that the adapter 1 enables repurposing of RF coaxial cables 5 as electrical power transmission lines with a maximum current capacity. Where the adapter 1 is configured with coaxial features, the body 9 may be cost efficiently manufactured with high precision, for example in computer numerical controlled metal machining/turning modules. Because the adapter 1 may be provided as a unitary monolithic body, the internal electrical interconnections through the body 1 between the conductor junction 15, outer conductor contacting portion 19 of the mating surface 17 and inner conductor contacting portion 21 of the mating surface 17 may be considered highly reliable as internal multiple element assembly issues such as material creep and/or corrosion cannot occur.

Table of Parts

| | |
|---|---|
| 1 | adapter |
| 3 | coaxial interface |
| 5 | RF coaxial cable |
| 7 | power conductor |
| 9 | body |
| 11 | connector end |
| 13 | conductor end |
| 15 | conductor junction |
| 17 | mating surface |
| 19 | outer conductor mating portion |
| 21 | inner conductor mating portion |
| 23 | cylindrical projection bore |
| 24 | coupling nut |
| 25 | contact pin |
| 27 | spring basket |
| 29 | inner conductor cavity |
| 31 | dielectric boot |
| 33 | power conductor jacket |
| 35 | coaxial cable jacket |
| 37 | dielectric heat shrink sleeve |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. An adapter for coupling a coaxial interface to a power conductor, comprising:

a body with a connector end and a conductor end;

a conductor junction at the conductor end dimensioned to couple with the power conductor;

a mating surface at the connector end dimensioned to couple with the coaxial interface;

the conductor junction, an outer conductor contacting portion of the mating surface and an inner conductor contacting portion of the mating surface coupled together electrically.

2. The adapter of claim 1, wherein the conductor junction is coaxial with the outer conductor contacting portion.

3. The adapter of claim 1, wherein the conductor junction is a cylindrical projection from the conductor end, coaxial with a longitudinal axis of the body.

4. The adapter of claim 1, wherein the body, the conductor junction, and the mating surface is a unitary monolithic portion of metal.

5. The adapter of claim 1, further including a dielectric boot dimensioned to seat along a jacket of the power conductor, surrounding a longitudinal extent of an outer diameter of the body.

6. The adapter of claim 1, further including a coupling nut dimensioned to retain the body against the coaxial interface.

7. The adapter of claim 1, wherein the inner conductor contacting portion is a contact pin seated in an inner conductor cavity of the body.

8. The adapter of claim 1, wherein the mating surface is dimensioned to couple with a female 7-16 DIN connector interface.

9. The adapter of claim 1, wherein the mating surface is dimensioned to couple with a Type-N connector interface.

10. A method for coupling a power conductor to a coaxial interface, comprising the steps of:

coupling the power conductor to a conductor junction at a conductor end of a body; and coupling the coaxial interface to a mating surface provided at a connector end of the body;

the conductor junction, an outer conductor contacting portion of the mating surface and an inner conductor contacting portion of the mating surface coupled together electrically by the body.

11. The method of claim 10, further including the step of seating a dielectric boot along a jacket of the power conductor, surrounding a longitudinal extent of an outer diameter of the body.

12. The method of claim 11, further including the step of enclosing the connection interface between the dielectric boot and a jacket of a coaxial cable coupled to the connection interface.

13. The method of claim 12, wherein the sealing is via application of a dielectric heat shrink sleeve.

14. The method of claim 10, wherein the conductor junction is coaxial with the outer conductor contacting portion.

15. The method of claim 10, wherein the conductor junction is a cylindrical projection from the conductor end, coaxial with a longitudinal axis of the body.

16. The method of claim 10, wherein the body, the conductor junction, and the mating surface is a unitary monolithic portion of metal.

17. The method of claim 10, wherein the coupling between the coaxial interface and the mating surface is via a coupling nut dimensioned to retain the body against the coaxial interface.

18. The method of claim 10, wherein the inner conductor contacting portion is a contact pin seated in an inner conductor cavity of the body.

19. The method of claim 10, wherein the mating surface is dimensioned to couple with a 7-16 DIN connector interface.

20. The method of claim 10, wherein the mating surface is dimensioned to couple with a Type-N connector interface.

* * * * *